United States Patent [19]

Pal et al.

[11] Patent Number: 4,733,853

[45] Date of Patent: Mar. 29, 1988

[54] MOLTEN METAL TAPHOLE DESIGN TO IMPROVE YIELD AND CLEANLINESS

[75] Inventors: Uday B. Pal, Monroeville; William F. Knauss, Jr., Pittsburgh, both of Pa.

[73] Assignee: Allegheny Ludlum Corporation, Pittsburgh, Pa.

[21] Appl. No.: 15,418

[22] Filed: Feb. 17, 1987

[51] Int. Cl.[4] ..... C21C 5/42

[52] U.S. Cl. ..... 266/272; 266/230

[58] Field of Search ..... 266/44, 45, 227, 228, 266/230, 271, 272; 222/597, 594, 606

[56] References Cited

U.S. PATENT DOCUMENTS

| | | | |
|---|---|---|---|
| 3,028,642 | 4/1962 | Stauffer | 222/606 |
| 4,368,834 | 11/1983 | Daussan et al. | 222/597 |
| 4,431,169 | 2/1984 | Fuzii et al. | 266/236 |
| 4,478,392 | 10/1984 | Fuzii | 266/44 |
| 4,553,743 | 11/1985 | LaBate et al. | 266/272 |
| 4,639,927 | 1/1987 | Uno et al. | 266/230 |

OTHER PUBLICATIONS

"Improved BOP/Q-BOP Taphole Design and Tapping Practice", by J. G. Yount, Jr. et al, Iron and Steel Society/AIME, 64th Steelmaking Conference, Ontario, Mar. 1981.

"Vortex Formation During Drainage of Meallurgical Vessels", by P. Hammerschmid et al, *Iron and Steelmaking*, 1984, vol. 11, No. 6, p. 332.

"The U.S. Steel Refractory Cube Technique to Minimize Tap Slag Carryover", by D. M. Ball et al, Iron and Steel Society/AIME, 66th *Steelmaking Conference, Georgie*, Apr. 1983, Advertisement for Kurosaki Refractories Co., Ltd. for Slagnon.

*Primary Examiner*—L. DeWayne Rutledge
*Assistant Examiner*—S. Kastler
*Attorney, Agent, or Firm*—Patrick J. Viccaro

[57] ABSTRACT

A taphole structure for BOF vessels that will prevent slag entrapment through vortexing and allow most of the metal to be tapped free of slag. This is accomplished through the use of a refractory member of generally tubular configuration which extends through the sidewall of the BOF vesssel and has a closed end portion extending into the vessel. The sidewall openings are provided in the tubular refractory member closely adjacent its closed end such that the molten metal will not flow directly into the end of the tubular refractory member but rather will flow into the refractory member through the sidewall openings, thereby creating an irrotational flow of metal into the tubular structure in the last stages of tapping without vortexing.

6 Claims, 4 Drawing Figures

MOLTEN METAL TAPHOLE DESIGN TO IMPROVE YIELD AND CLEANLINESS

BACKGROUND OF THE INVENTION

While not limited thereto, the present invention is particularly adapted for use with basic oxygen furnaces utilized in the steel industry. In a typical BOF of this type, the end of tapping (i.e., pouring molten metal from the vessel) is characterized by the level metal at the tap hole being below a critical height at which the slag above the metal begins to vortex through the metal and occupies the core of the molten metal stream coming out. This can be compared to water draining from a sink. As the water level falls, a point is reached where a vortex occurs over the drain; and water from the surface is sucked down into the vortex. In order to tap clean steel (i.e., steel with no slag entrapment), the tapping procedure must be stopped using present-day prior art techniques when approximately 10% of the total steel is still in the BOF.

The tap hole of a typical BOF has its opening facing the slag-metal interface. Detection of slag in the metal stream is not easy since it is usually in the core of the stream and cannot be seen.

In the past, various techniques have been used to prevent vortexing of the type described above. For example, electro-magnetic devices have been devised which detect the start of slag vortexing. These devices are very reliable, but unfortunately they are also very expensive and in many cases they do not justify their implementation from the point of view of cost. Cheaper methods such as using a refractory cube, which floats at the slag-metal interface and delays the start of slag vortexing, are not altogether reliable as are pneumatic devices. In short, existing methods of tapping slag-free steels are either very expensive or unreliable, with the result that vortexing of the slag has continued to be a bottleneck in obtaining the maximum obtainable yield of clean steel from the BOF.

SUMMARY OF THE INVENTION

In accordance with the present invention, a new and improved taphole arrangement for BOF furnaces and the like is disclosed which essentially eliminates slag vortexing.

Specifically, the taphole structure of the invention includes a refractory member of generally tubular configuration extending through the sidewall of the vessel and having a closed-end upper portion extending into the vessel. The closure at the upper end of the tubular refractory member preferably extends parallel to the slag-metal interface during the final stages of tapping. Sidewall openings are provided in the tubular refractory member closely adjacent its closed upper end whereby the molten metal will not flow directly into the end of the tubular refractory member but, rather, will flow into the refractory member through the sidewall openings. In this manner, slag will not materially vortex into the taphole, the vessel can be rotated to a greater angle with respect to the vertical during tapping, and a greater amount of slag-free metal can be tapped from the vessel for any given heat.

The above and other objects and features of the invention will become apparent from the following detailed description taken in connection with accompanying drawings which form a part of this specification.

BRIEF DESCRIPTION OF THE PREFERRED EMBODIMENTS

Figure 1A:
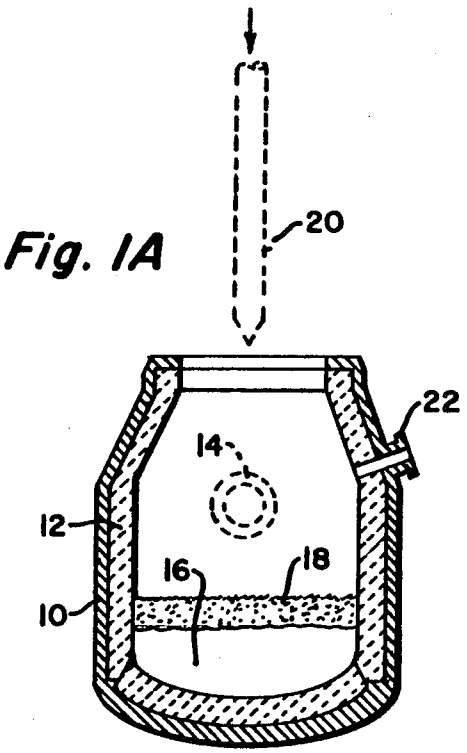
FIGS. 1A and 1B illustrate a typical BOF steel-making furnace in its upright or vertical position and in its inclined, tapping position, respectively.
Figure 1B:
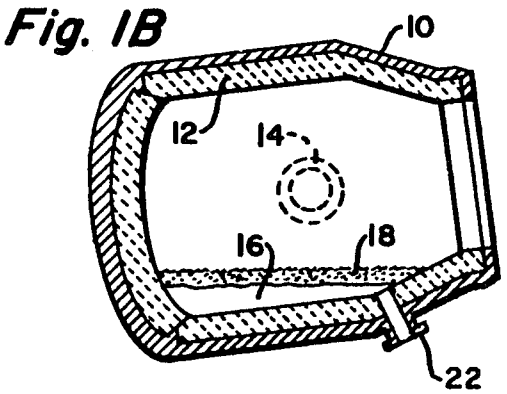

With reference to FIGS. 1A and 1B, there is shown a typical BOF furnace which comprises an outer steel shell 10 lined with refractory brick 12. The furnace is mounted on trunions 14 extending outwardly from opposite sides of the steel shell 10 such that structure may be rotated from the vertical position shown in FIG. 1A, for example, to the inclined position shown in FIG. 1B.

Generally, within the vessel are charged molten iron, steel scrap and slag-forming materials which form a molten metal bath 16 at the bottom of the furnace shown in FIG. 1A covered by a molten slag layer 18. In order to convert the iron, scrap, and slag forming materials and refine the steel, an oxygen lance 20 is lowered down into the furnace and blows oxygen onto the surface of the slag and molten metal layers 18 and 16, during which process carbon and silicon is oxidized as well as other elements. At the termination of the refining process, the vessel is then rotated as shown in FIG. 1B.

In the side of the vessel, approximately midway between the trunions 14, is a taphole 22 through which the molten steel flows into a ladle or the like. The level of the molten metal bath within the vessel is normally such that when the vessel is rotated to about 60 degrees from its vertical position, molten metal starts to flow through the tap hole 22. Continued rotation of the vessel causes additional molten metal to flow out of the taphole 22 until the vessel typically is at an angle of about 90 degrees with respect to vertical, at which point the tapping procedure must be stopped. This is for the reason that at this point, vortexing occurs directly above the taphole 22 and draws slag into the exiting stream as explained above.

Figure 2:
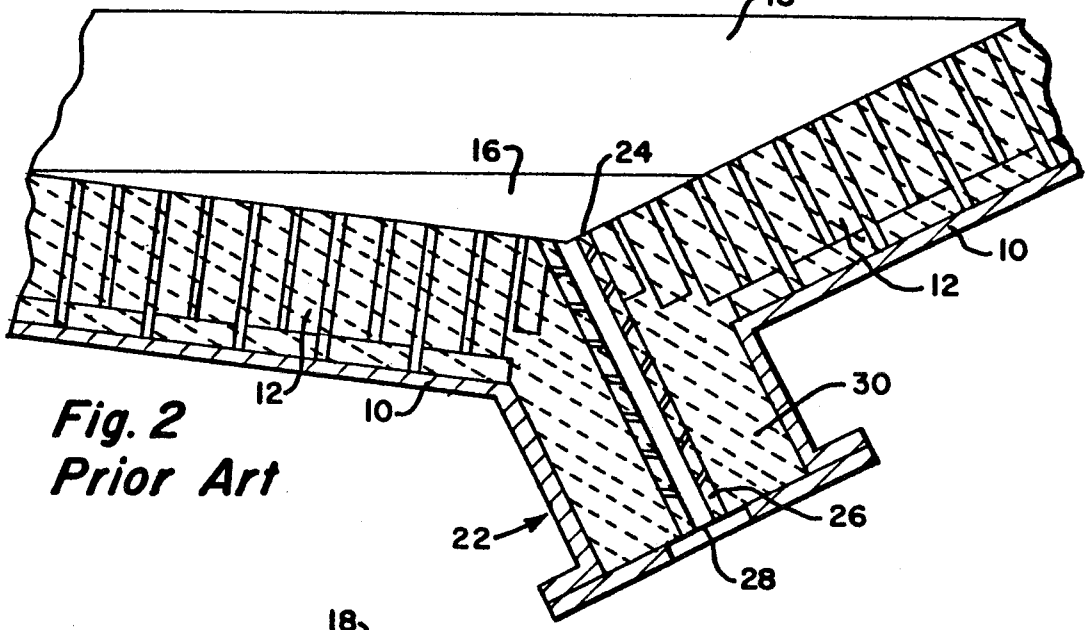
Fig. 2 Prior Art
FIG. 2 is an illustration of a prior art taphole construction subject to the vortexing problem described above.

FIG. 2 illustrates a typical prior art BOF tap hole arrangement during the last stages of tapping when approximately 90% of the steel has been tapped. The standard taphole opens into the interior of the vessel at 24 and is formed by bricks which are bored with circular openings to produce elongated tubular opening 28 comprising the taphole itself. Surrounding the bricks 26 is packed refractory material 30. Instead of the bricks 26, the taphole 28 sometimes can be formed by a replaceable refractory tube imbedded in the packing 30.

Figure 3:
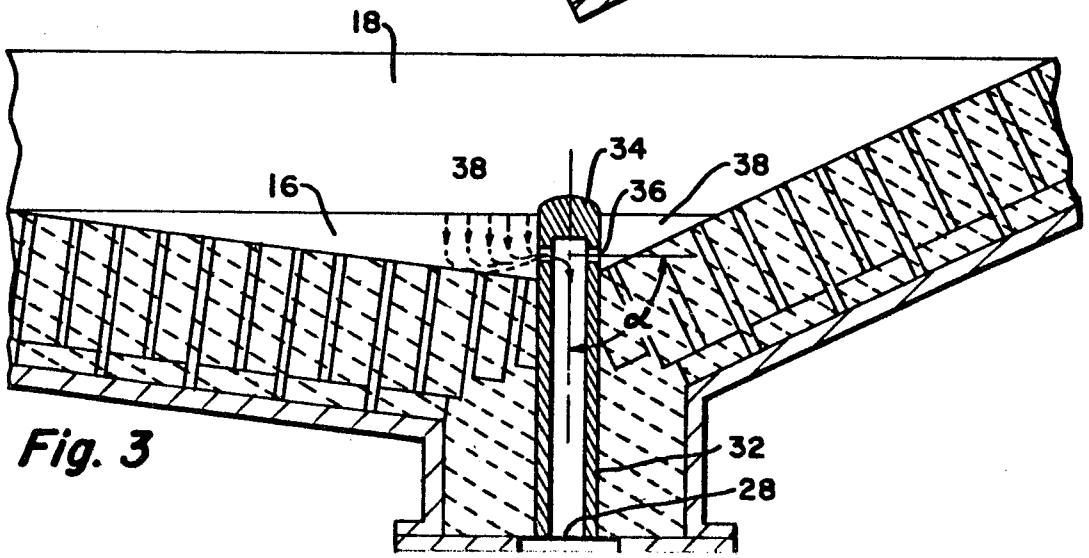
FIG. 3 is an illustration similar to that of FIG. 2, but incorporating the improved taphole construction of the present invention.

With reference now to FIG. 3, the improved taphole construction of the present invention is shown wherein elements corresponding to those shown in FIGS. 1 and 2 are identified by like reference numerals. In this case, the tap hole 28 is formed by a refractory insert 32 which has an upper, closed end 34 which extends into the molten metal 16 during tapping. In the upper end of the refractory tube 32 adjacent its closed end 34 are radially-existing spaced holes 36 through which the molten metal flows. The combined cross-sectional areas of the openings 36 are substantially equal to the cross-sectional area of the taphole 28 itself. As can be seen, in the present invention the tubular taphole structure extends into the molten steel 16 at right angles to the slag-metal interface 38. In other words, the upper and lower surfaces of the closed end 34 are substantially parallel to the slag-metal interface. During the last stages of tapping (i.e., when about 92% of the steel has been tapped), the sealed or closed end portion 34 preferably intersects the slag-metal interface 38. In a typical 80 ton BOF, for example, the above requirements will be satisfied if the extension which extends into the side of the vessel is about 9 to 10 inches in length. The taphole openings 36, which will typically number 2 or 3, are located at the sides of the extended tubular taphole structure just below the closed end 34. Not only must the cross sectional areas of the openings 36 be substantially equal to that of the taphole 28, they must also satisfy a free flow criteria. It is also desirable or necessary that the openings be symmetrical and that the angle ($\alpha$) between the axis of any of these openings and the axis of the tubular insert 32 be less than or equal to 90 degrees and preferably between 85 degrees and 90 degrees. It is also desirable that the portion of the extended structure above the openings 36 be of solid refractory material to give better rigidity. The thickness of the tubular insert 32, where the side openings 36 are located, must be based on the rate of refractory wear and the number of heats desired. The entire insert 32 is of a disposable nature and can be replaced when worn out. In the design of the taphole, such as that shown in FIG. 3, the slag-metal interface 38 should touch the sealed portion of the extended taphole structure during the last stages of tapping.

The flow through the tubular taphole structure of the invention can be described as "irrotational". In such a flow there is no vortex and the flow streamlines 38 are shown in FIG. 3. As a consequence, with no slag vortexing, the taphole structure of the invention gives a much better yield.

With the prior art arrangement of FIG. 2, only about 92% of the steel can be tapped before vortexing occurs. At this point, the vessel has rotated about 93 degrees with respect to vertical. In the improved taphole structure of the present invention shown in FIG. 3, the vessel can be rotated through 98 degrees without vortexing occurring to achieve a more complete discharge of the heat.

Although the invention has been shown in connection with a certain specific embodiment, it will be readily apparent to those skilled in the art that various changes in form and arrangement of parts may be made to suit requirements without departing from the spirit and scope of the invention.

We claim as our invention:

1. A taphole structure for refractory-lines vessels containing molten metal having an overlying slag layer and wherein the taphole extends through the sidewall of the vessel at the top portion thereof whereby rotation of the vessel from an upright position to an inclined position will cause molten metal to flow through the taphole; said taphole structure comprising:

a refractory member of generally tubular configuration extending through the sidewall of said vessel and having a sealed closed-end portion impervious to the flow of liquid metal while extending into molten metal in the vessel during tapping, and sidewall openings in said tubular refractory member closely adjacent its sealed closed end which extends into the vessel whereby molten metal will not flow directly into the end of the tubular refractory member but rather will flow into the refractory member through said sidewall openings with an irrotational flow, whereby slag will not materially vortex into the taphole, the vessel can be rotated to a greater angle with respect to vertical during tapping, and a greater number of slag-free metal can be tapped from the vessel even when said sealed closed end touches a slag-metal interface in the vessel during tapping.

2. The taphole structure of claim 1 wherein the axis of said sidewall openings are at an angle of between 85 degrees and 90 degrees with respect to the axis of the taphole structure itself.

3. The taphole structure of claim 2 wherein the number of said sidewall openings is in the range of 2 to 3.

4. The taphole structure of claim 1 wherein the combined cross sectional areas of said sidewall openings is at least equal to the cross-sectional area of the interior opening in said tubular refractory member.

5. The taphole structure of claim 1 wherein said generally tubular refractory member assumes an angle of about 90 degrees with respect to the metal-slag interface in the vessel at the completion of the tapping operation.

6. The taphole structure of claim 1 wherein said refractory member of generally tubular configuration is formed from a solid, integral refractory material.

* * * * *